US005267169A

United States Patent [19]

Yokoe et al.

[11] Patent Number: 5,267,169

[45] Date of Patent: Nov. 30, 1993

[54] NON-RAVEL STITCH DATA CREATING METHOD AND DEVICE FOR SEWING MACHINE

[75] Inventors: Masaaki Yokoe, Nagoya; Yoshikazu Kurono, Hazu, both of Japan

[73] Assignee: Brother Kogyo Kabushiki Kaisha, Nagoya, Japan

[21] Appl. No.: 676,526

[22] Filed: Mar. 28, 1991

[30] Foreign Application Priority Data

May 22, 1990 [JP] Japan ..... 2-132337

[51] Int. Cl.[5] ..... G06F 15/46

[52] U.S. Cl. ..... 364/470; 112/121.11; 112/121.12

[58] Field of Search ..... 364/470; 112/317, 459, 112/462, 444, 121.11, 121.12, 121.13

[56] References Cited

U.S. PATENT DOCUMENTS

| | | | |
|---|---|---|---|
| 4,078,506 | 3/1978 | Sasaki | 112/444 |
| 4,182,252 | 1/1980 | Yoneji et al. | 112/317 |
| 4,186,675 | 2/1980 | Yamashita et al. | 112/462 |
| 4,235,176 | 11/1980 | Yamashita et al. | 112/459 |
| 4,262,614 | 4/1981 | Sugaya et al. | 112/451 |
| 4,326,472 | 4/1982 | Yamashita et al. | 112/459 |
| 4,722,288 | 2/1988 | Nomura et al. | 112/121.11 |
| 4,732,095 | 3/1988 | Saito et al. | 112/121.11 |
| 4,849,902 | 7/1989 | Yokoe et al. | 112/121.12 |

FOREIGN PATENT DOCUMENTS 1-262891 10/1989 Japan .

*Primary Examiner*—Jerry Smith
*Assistant Examiner*—Jim Trammel
*Attorney, Agent, or Firm*—Oliff & Berridge

[57] ABSTRACT

A non-ravel stitch data creating method and device for a sewing machine capable of forming a stitch pattern according to stitch pattern data stores stitch pattern data and determines whether or not any stitch pitches of a predetermined number of stitches at at least one of the start and the end of the stitch pattern is equal to or greater than a reference pitch based on the stored stitch pattern data. Non-ravel stitch data is created for performing non-ravel stitching at a stitch pitch less than any stitch pitch of the predetermined number of stitches at at least one of the start and the end of the stitch pattern when a result of the determination is affirmative. Non-ravel stitch data is not created when the result of the determination is negative.

13 Claims, 7 Drawing Sheets

NON-RAVEL STITCH DATA CREATING METHOD AND DEVICE FOR SEWING MACHINE

BACKGROUND OF THE INVENTION

1. Field of the Invention

The present invention relates to a method and device for use in a sewing machine and, more particularly to a method and device for creating non-ravel stitch data for a sewing machine.

2. Description of the Related Art

Generally, a sewing machine is provided with a stitch forming device including a mechanism for reciprocating a needle and also including a loop taker for forming stitches in cooperation with the needle. A sewing machine is further provided with a material moving device for moving a material to be sewn, e.g., a work fabric, in a direction perpendicular to a reciprocating direction of the needle. The sewing machine is designed to automatically form a stitch pattern on the material to be sewn, by controlling the material moving device according to stitch pattern data in synchronism with the reciprocation of the needle.

Meanwhile, it is known that non-ravel stitching for preventing fray of a seam end is performed at at least one of the start and the end of the stitch pattern. There is disclosed in Japanese Laid-open Patent No. 1-262891 (laid open on Oct. 19, 1989) a device for automatically creating non-ravel stitch data for performing the non-ravel stitching operation.

The sewing machine described in the above cited reference can automatically form a stitch pattern on a work fabric according to stitch pattern data. This sewing machine can also automatically perform processing of the stitch pattern data, so as to expand or contract the stitch pattern. Further, this sewing machine can automatically perform creation of the non-ravel stitch data, so as to perform the non-ravel stitching at the start and/or the end of the stitch pattern.

In the above conventional sewing machine, the non-ravel stitching is always performed at the start and/or the end of the stitch pattern. However, when a pitch of each stitch itself constituting the stitch pattern is small, there is no possibility of fray of the seam end, and it is therefore unnecessary to perform the non-ravel stitching. Particularly when the stitch pattern is contracted to markedly reduce the stitch pitch, undue non-ravel stitching makes the stitches of the stitch pattern appear bulbous, thus deteriorating the appearance of a sewn product.

SUMMARY OF THE INVENTION

It is an object of the present invention to provide a non-ravel stitch data creating device which creates non-ravel stitch data when non-ravel stitching is required, but does not create the non-ravel stitch data when non-ravel stitching is not required.

According to the present invention achieving the above object, there is provided a non-ravel stitch data creating device for a sewing machine capable of forming a stitch pattern according to stitch pattern data, the non-ravel stitch data creating device comprising: stitch pattern data storing means for storing the stitch pattern data; stitch pitch determining means for determining whether or not any one of stitch pitches of a predetermined number of stitches at at least one of the start and the end of the stitch pattern is equal to or greater than a predetermined reference pitch, based on the stitch pattern data stored in the stitch pattern data storing means; and non-ravel stitch data creating means for creating non-ravel stitch data for carrying out non-ravel stitching at a stitch pitch less than any stitch pitch of the predetermined number of stitches at at least one of the start and the end of the stitch pattern when a result of the determination by the stitch pitch determining means is affirmative, and for creating no non-ravel stitch data when the result of determination by the stitch pitch determining means is negative.

In the non-ravel stitch data creating device of the present invention, the stitch pitch determining means determines whether or not any one of stitch pitches of the predetermined number of stitches at at least one of the start and the end of the stitch pattern is equal to or greater than the reference pitch, based on the stitch pattern data stored in the stitch pattern data storing means. If the result of determination by the stitch pitch determining means is YES, that is, only when a predetermined number of stitches includes any stitch having a stitch pitch equal to or greater than the reference pitch, the non-ravel stitch data creating means creates the non-ravel stitch data. Thus, when the result of the determination is affirmative, the stitch pitches are judged as being sufficiently large to require non-ravel stitching. On the other hand, when the result of the determination is negative, the stitch pitches are judged as being small enough to not require non-ravel stitching since fray of the seam end is unlikely.

Accordingly, by setting the reference pitch to a minimum value of the stitch pitch which requires the non-ravel stitch, the non-ravel stitch data is created when non-ravel stitching is required, while when non-ravel stitching is not required, the non-ravel stitch data is not created. Thus, the non-ravel stitching is carried out only when the non-ravel stitching is required, thereby avoiding the deterioration of appearance of a sewn product due to unnecessary non-ravel stitching.

Particularly in the case of expanding or contracting the stitch pattern, the determination of the requirement of non-ravel stitching depends on a stitch pitch following expansion or contraction of the stitch pattern. It is impossible, therefore, to initially decide whether or not the non-ravel stitching is required. According to the non-ravel stitch data creating device of the present invention, however, it is possible to properly determine whether or not the non-ravel stitching is required according to the stitch pattern data after the execution of expansion or contraction processing.

BRIEF DESCRIPTION OF THE DRAWINGS

A preferred embodiment of the present invention will be described in detail with reference to the following figures, wherein.

DETAILED DESCRIPTION OF THE PREFERRED EMBODIMENTS

Figure 1:
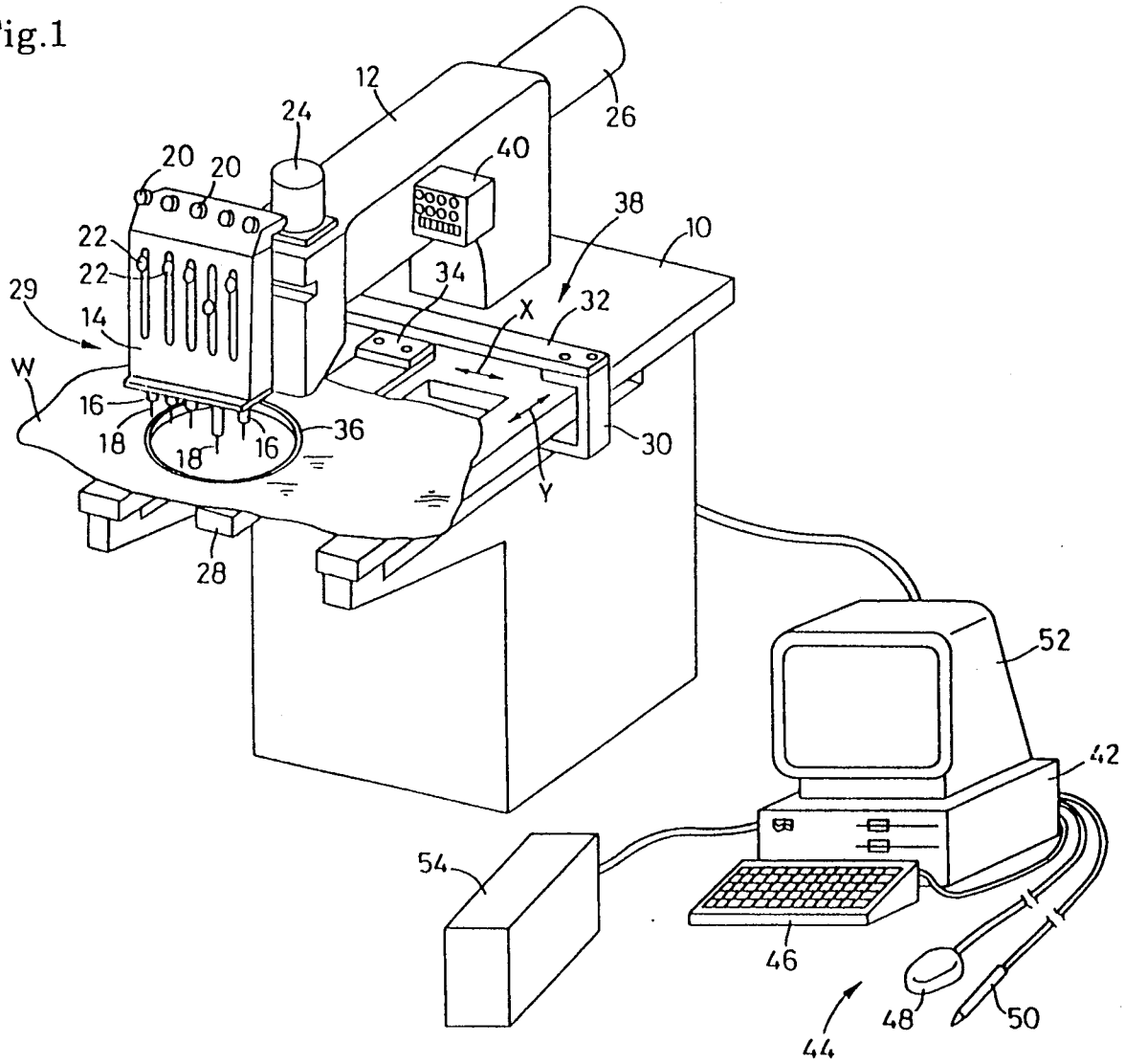
FIG. 1 is a perspective view of an automatic sewing machine including the non-ravel stitch data creating device according to a first preferred embodiment of the present invention.

Referring now to the drawings, and more particularly to FIG. 1 thereof, there will first be described an automatic sewing machine including a non-ravel stitch data creating device according to a first preferred embodiment of the present invention. A sewing machine arm 12 is provided on a sewing machine table 10. A needle bar supporting case 14 is laterally movably mounted on a front end of the arm 12. Five needle bars 16 are vertically movably supported by the needle bar supporting case 14. Five needles 18 are mounted at lower ends of the five needle bars 16, respectively. These needles 18 are supplied with different kinds or colors of threads from a thread supply source (not shown) through thread tension adjusters 20 and thread take-up levers 22 provided on the needle bar supporting case 14. A needle bar selecting motor 24 is mounted on the arm 12. The needle bar supporting case 14 is moved by driving the needle bar selecting motor 24, so that one of the five needle bars 16 and the corresponding needle 18 are selected to be located at an operating position.

The needle bar 16 located at the operating position is connected to a sewing machine motor 26 through a power transmitting mechanism (not shown) provided in the arm 12, and is vertically reciprocated by driving the motor 26. A sewing machine bed 28 projects frontwardly from the table 10 so as to be opposed to the needle bar 16 located at the operating position. A loop taker (not shown) for forming stitches on a work fabric W in cooperation with the needle 18 is provided in the bed 28. The needle bars 16, the needles 18, the motor 26 and the loop taker constitute a stitch forming device 29.

A pair of Y-direction moving frames 30 (one of which is shown in FIG. 1) are provided, one at a right end portion and one at a left end portion of the table 10, so as to be movable in opposite directions depicted by a double-headed arrow Y. Both Y-direction moving frames 30 can be moved an arbitrary distance in front and rear directions (Y direction) by a Y-axis driving motor (not shown). A supporting frame 32 extends laterally between both the Y-direction moving frames 30, and an X-direction moving frame 34 is supported by the supporting frame 32 so as to be movable in opposite directions depicted by a double-headed arrow X. The X-direction moving frame 34 can be moved an arbitrary distance in right and left directions (X direction) by an X-axis driving motor (not shown). A work fabric holding frame 36 for detachably holding the work fabric W is mounted on the X-direction moving frame 34. Accordingly, the work fabric holding frame 36 can be moved to an arbitrary position on an X-Y plane by driving the X-axis driving motor and the axis driving motor. The Y-direction moving frames 30, the Y-axis driving motor, the X-direction moving frame 34, the X-axis driving motor and the work fabric holding frame 36 constitute a work fabric feeding device 38.

A sewing machine operating device 40 is provided on a side surface of the arm 12. A main control device 42 is connected to the automatic sewing machine, and an input device 44 is connected to the main control device 42. The input device 44 includes a keyboard 46, a mouse 48 and a light pen 50. The mouse 48 and the light pen 50 are used to input data in cooperation with a display device 52. The display device 52 is also used to display data received from the keyboard 46, data created in the main control device 42, and data transmitted from the automatic sewing machine. An external storage 54 is also connected to the main control device 42. The external storage 54 is comprised of a magnetic disk device or a magnetic tape device.

Figure 2:
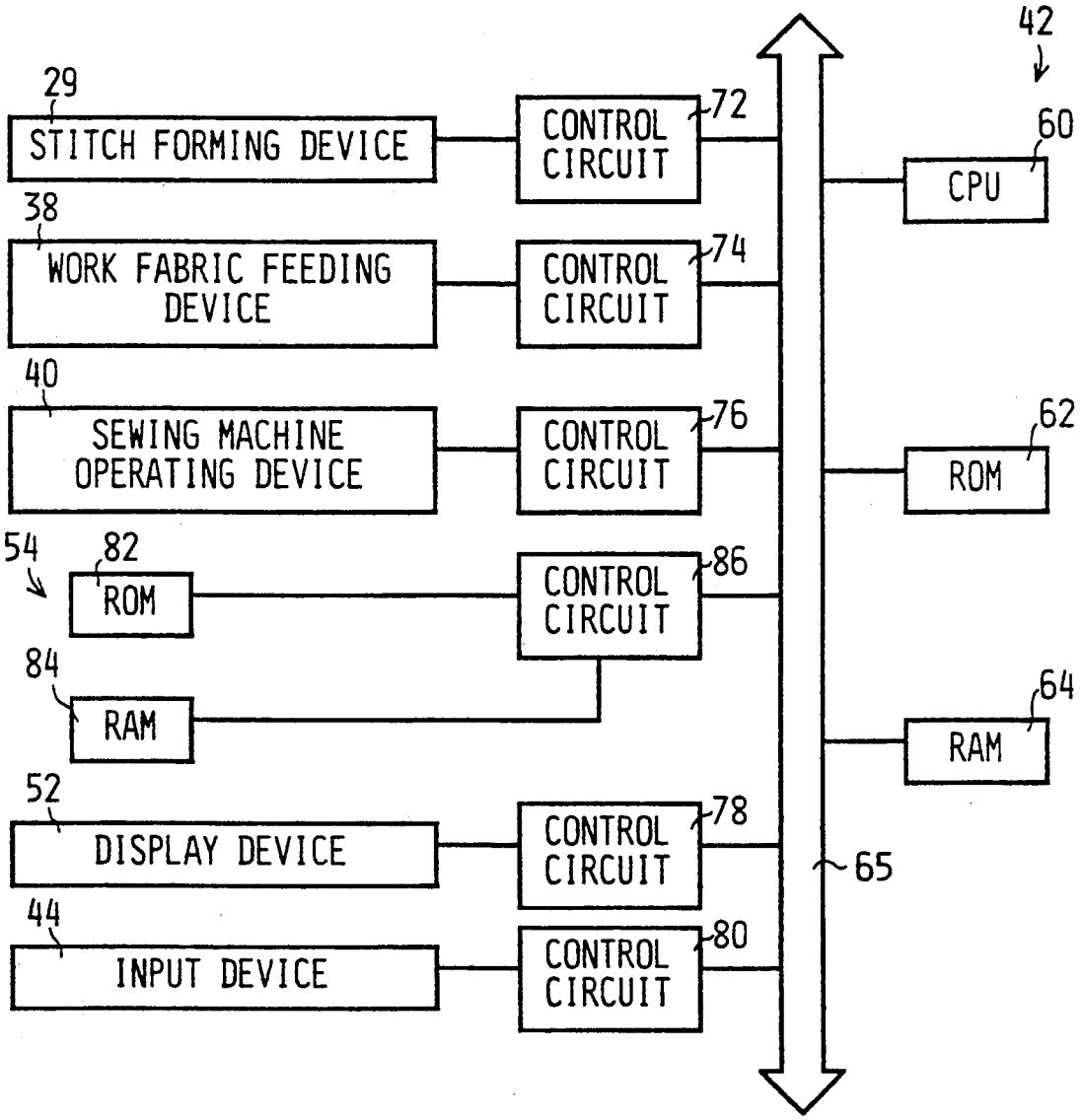
FIG. 2 is a block diagram showing a control section in the automatic sewing machine.
Figure 3:
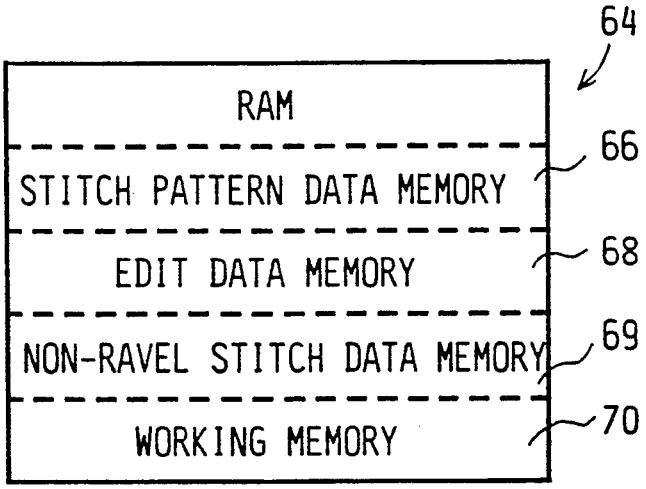
FIG. 3 is a schematic illustration of the construction of a RAM in the control section.

The construction of a control section of the automatic sewing machine is shown in FIG. 2. The main control device 42 is primarily constructed of a computer including a CPU 60, ROM 62, RAM 64 and bus 65 connecting them together. As shown in FIG. 3, the RAM 64 includes a stitch pattern data memory 66, edit data memory 68, non-ravel stitch data memory 69 and working memory 70. In the ROM 62, there are previously stored various control programs including a contraction processing routine represented by a flowchart in FIG. 4 and a stitch forming routine represented by a flowchart in FIG. 5.

The stitch forming device 29, the work fabric feeding device 38, the sewing machine operating device 40, the display device 52 and the input device 44 are connected to the CPU 60 through control circuits 72, 74, 76, 78 and 80, respectively. The external storage 54 is provided with a part functioning as a ROM 82, a part functioning as a RAM 84, and a control circuit 86. The ROM 82 and the RAM 84 are connected through the control circuit 86 to the CPU 60.

In the automatic sewing machine as constructed above, stitch pattern data for forming various stitch patterns is previously stored in the external storage 54. The stitch pattern data consists of a plurality of needle location data. When the formation of a desired stitch pattern is required, the stitch pattern data is read from the external storage 54 into the stitch pattern data memory 66 in the RAM 64. The CPU 60 controls the work fabric feeding device 38 in synchronism with the reciprocation of the needle 18 according to the stitch pattern data read into the stitch pattern data memory 66 and the stitch forming routine stored in the ROM 62. As a result, the desired stitch pattern is formed on the work fabric W, and as required, non-ravel stitching is carried out at the start of the stitch pattern.

The stitch pattern can normally be formed in accordance with the read stitch pattern data. However, the stitch pattern can be changed in direction or size by expansion or contraction. When changing the direction or size of the stitch pattern, the plural needle location data constituting the stitch pattern data is processed by the CPU 60. The stitch pattern data processed by the CPU 60 is stored into the edit data memory 68 in the RAM 64. Then, the expanded, contracted or rotated stitch pattern is formed according to the data stored into the edit data memory 68.

Figure 6:
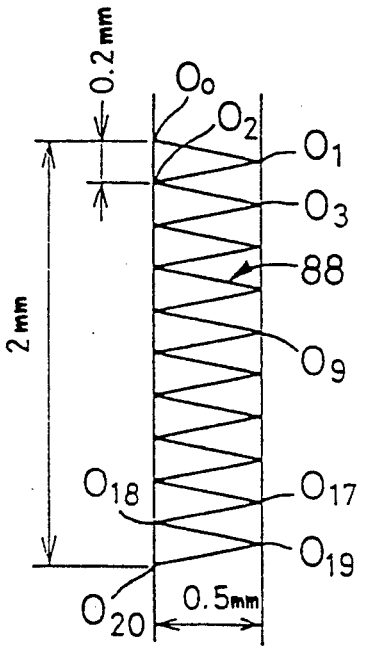
FIGS. 6, 7, 8 and 9 are illustrations explaining the execution of the above flowcharts.
Figure 7:
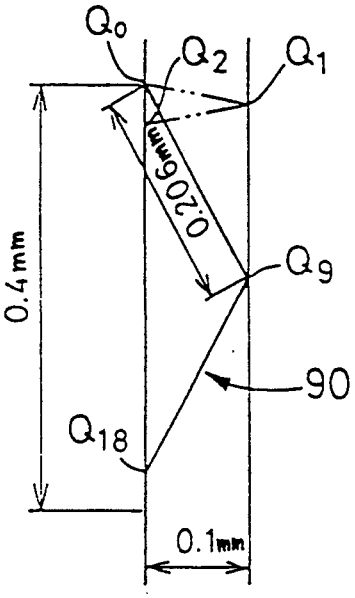

As the edit processing for the expansion or rotation of the stitch pattern is well known, the explanation thereof will be omitted hereinafter, and the following description will be directed solely to the edit processing for the contraction of the stitch pattern. It is assumed that a zigzag pattern 88 as shown in FIG. 6 is selected, and that stitch pattern data for forming the zigzag pattern 88 is stored in the stitch pattern data memory 66. When forming a stitch pattern according to this stitch pattern data, twenty stitches are formed in an area of 2 mm×0.5 mm to form the zigzag pattern 88. When instructing that the stitch pattern is to be contracted to 1/5 and, thereby, simply contracting the stitch pattern shown in FIG. 6 to 1/5, twenty stitches are formed in a minute area of 0.4 mm×0.1 mm, with the result that the stitches become bulbous, and the appearance of the stitch pattern is deteriorated. To cope with this defect, the automatic sewing machine of the preferred embodiment is designed to omit most of the stitches and form a zigzag pattern 90 as shown in FIG. 7. The contraction processing routine for the formation of the zigzag pattern 90 will now be described with reference to the flowchart shown in FIG. 4.

First in step S1, the stitch pattern data is processed to contract the stitches to 1/5. That is, the stitch pattern data is composed of twenty-one needle location data representing coordinates of points $O_0$ to $O_{20}$. The first two points $O_0$ and $O_1$ of this needle location data are read out of the stitch pattern data memory 66, and these two coordinate values are contracted to 1/5 to provide temporary contraction stitch pattern data.

In the next step S2, a stitch pitch $P_n$ (n=1, 2, . . . ) is computed according to the temporary contraction stitch pattern data. That is, a stitch pitch $P_1$ is computed according to two points $Q_0$ and $Q_1$ shown in FIG. 7 which points have coordinate values contracted at a contraction rate of 1/5 from the coordinate values of the points $O_0$ and $O_1$. That is, a length of a line segment $Q_0Q_1$ is computed. In step S3, it is determined whether the stitch pitch $P_1$ is equal to or greater than a contraction reference pitch $P_{NG}$. In the preferred embodiment, the contraction reference pitch $P_{NG}$ is set to 0.2 mm, and it is initially stored in the ROM 62. If the contraction rate is ½, the stitch pitch $P_1$ becomes about 0.25 mm. Therefore, the answer in step S3 is YES. In the next step S4, the needle location data corresponding to the point $Q_1$ is adopted as the contraction stitch pattern data, and is then stored into the edit data memory 68 in the RAM 64. If the other stitch pitches are equal to or greater than the contraction reference pitch $P_{NG}$, the answer in step S5 becomes YES during the repeated execution of steps S1 to S5. Thus, all the needle location data comprising the stitch pattern data are contracted to be stored into the edit data memory 68.

However, since the contraction rate is 1/5 in the case shown in FIG. 7, the stitch pitch $P_1$ becomes about 0.1 mm. Accordingly, the answer in step S3 is NO. Then, it is determined in step S6 whether the presently read needle location data (i.e., the coordinate value of the point $Q_1$ at this time) is final needle location data. Since the coordinate value of the point $Q_1$ is not the final needle location data, the answer in step S6 becomes NO. In the next step S7, a distance from the point $Q_0$ to a point $Q_2$ which is the next needle location, that is, a length of a line segment $Q_0Q_2$, is computed. Then, the length of the line segment $Q_0Q_2$ as the stitch pitch $P_n$ (i.e., $P_2$ at this time) is compared with the contraction reference pitch $P_{NG}$ in step S3. Since the answer in step S3 is naturally NO in the case of FIG. 7, the steps S6 and S7 are executed again. During the repeated execution of steps S3 to S7, a distance from the point $Q_0$ to a point $Q_9$ is computed to become about 0.206 mm, which value is greater than the value of 0.2 mm set as the contraction reference pitch $P_{NG}$. Accordingly, the answer in step S3 becomes YES, and in step S4, the needle location data representing the point $Q_9$ is stored as a proper or adoptable contraction stitch pattern data into the edit data memory 68.

In the next step S5, it is determined whether the needle location data representing the point $Q_9$ stored into the edit data memory 68 is final needle location data. Since the needle location data representing the point $Q_9$ is not the final needle location data, the answer in step S5 becomes NO, and the step S1 and the subsequent steps are executed. That is, the same processing as described above is carried out for the combination of the needle location data between the point $Q_9$ and each of the subsequent points $Q_{10}$ and so on. Since the answer in step S3 for the combination between the point $Q_9$ and a point $Q_{18}$ becomes YES, the needle location data representing the point $Q_{18}$ is stored as a proper or adoptable contraction stitch pattern data into the edit data memory 68.

Figure 4:
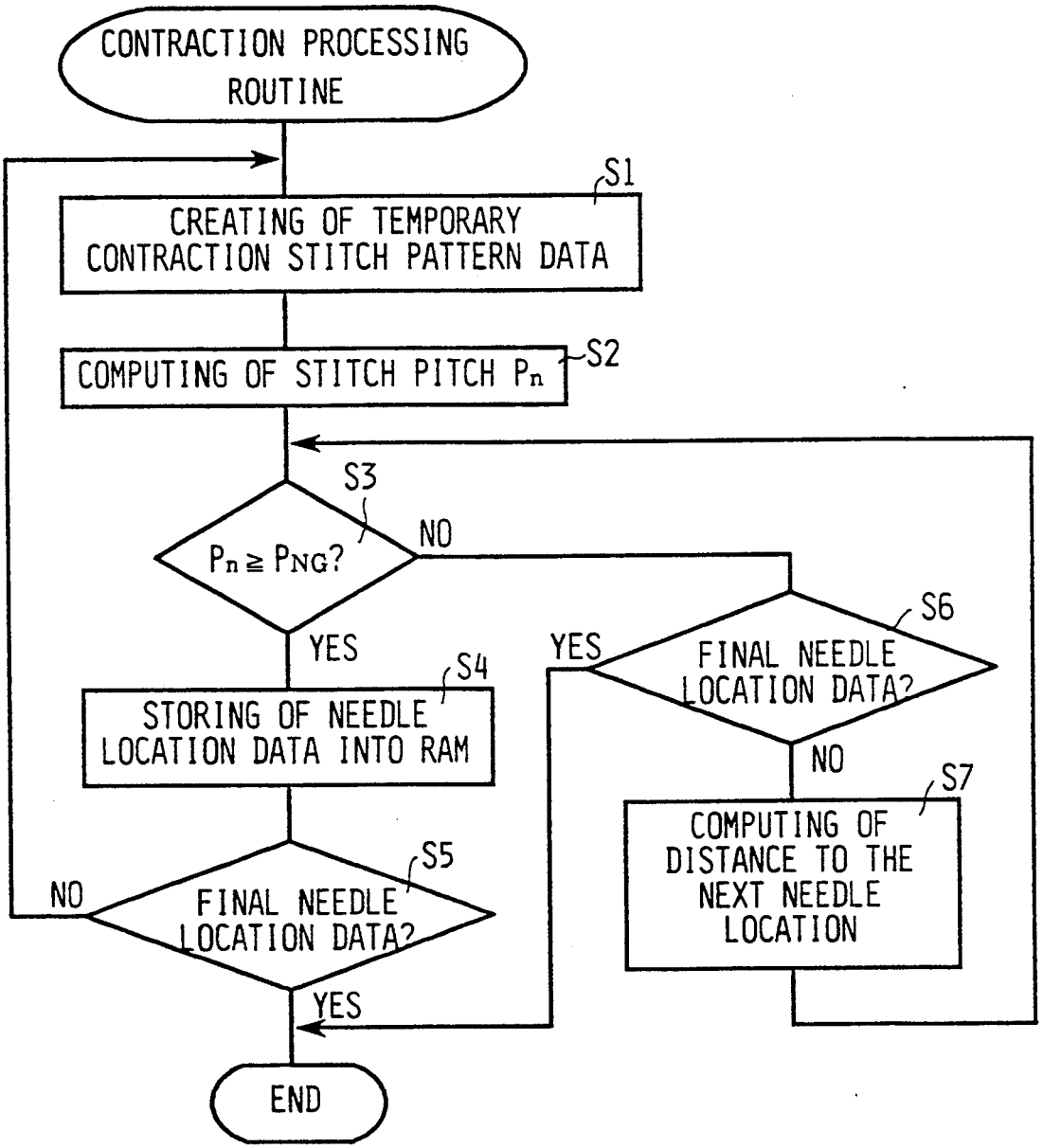
FIG. 4 is a flowchart of a contraction processing routine stored in a ROM in the control section.
Figure 5:
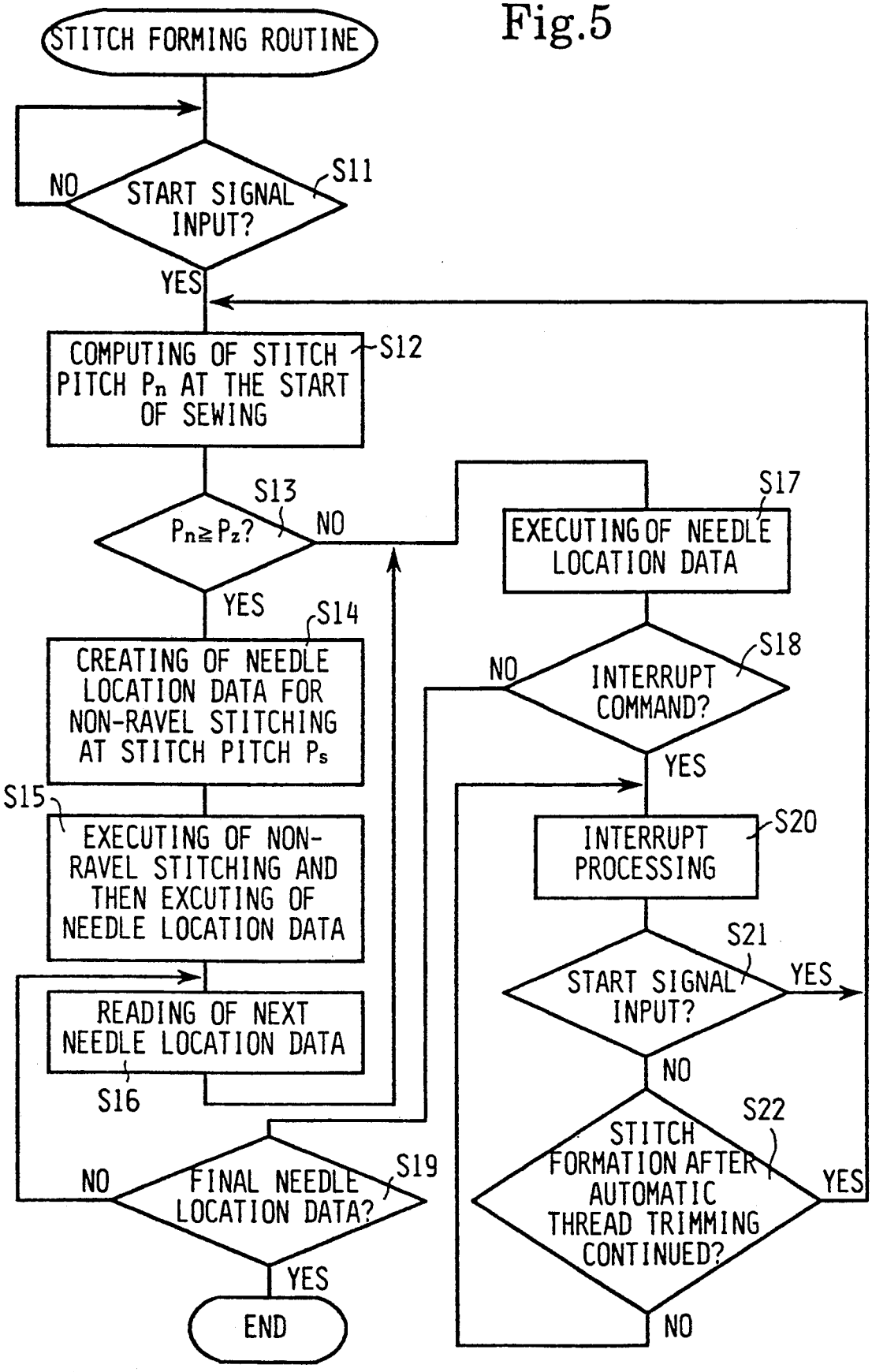
FIG. 5 is a flowchart of a stitch forming routine stored in the ROM.

Then, the determination of step S3 is carried out for the combination between the point $Q_{18}$ and a point $Q_{19}$, and subsequently for the combination between the point $Q_{18}$ and a point $Q_{20}$. The answer in step S3 for both the combinations becomes NO. Since the needle location data representing the point $Q_{20}$ is the final needle location data, the answer in step S6 becomes YES. Then, the contraction processing routine shown in FIG. 4 is ended. In this manner, the stitch pattern data consisting of the twenty-one needle location data representing the points $O_0$ to $O_{20}$ is converted into the contraction stitch pattern data consisting of the three needle location data representing the point $Q_0$, $Q_9$ and $Q_{18}$ by the contraction processing routine in the preferred embodiment.

In the above explanation, it is assumed that all the stitches of the stitch pattern have the same stitch pitch, for the purpose of easy understanding. However, in actuality, the stitches of the stitch pattern often have different stitch pitches. In this case, the stitch pattern often includes a portion where needle location data is disregarded and a portion where needle location data is not disregarded. For example, a small stitch pitch, when contracted, can become so small that needle location data is disregarded.

The above stitch pattern data processing for expansion or contraction of the stitch pattern is carried out prior to the start of operation of the sewing machine. In contrast, creation of non-ravel stitch data is carried out during the operation of the sewing machine by executing the stitch forming routine shown by the flowchart in FIG. 5. The stitch forming routine will now be described with reference to the flowchart shown in FIG. 5.

Figure 8:
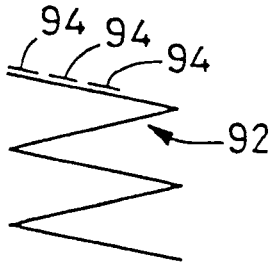
Figure 9:
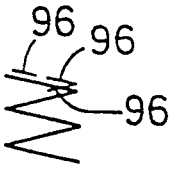

When the main control device 42 is placed in a condition where a stitch pattern can be formed, step S11 is repeatedly executed to await input of a start signal. Thereafter, when a start switch of the sewing machine operating device 40 is operated by an operator, the answer in step S11 becomes YES. In the next step S12, a stitch pitch $P_n$ at the start of sewing is computed. In the preferred embodiment, the first three stitch pitches of the stitch pattern to be formed are computed. In step S13, it is determined whether all of the three stitch pitches are equal to or greater than a predetermined non-ravel stitch reference pitch $P_z$. In the preferred embodiment, the non-ravel stitch reference pitch $P_z$ is set to 1 mm, and it is initially stored in the ROM 62. If all of the three stitch pitches are equal to or greater than 1 mm, the answer in step S13 becomes YES, and non-ravel stitch data is created in step S14. Then in step S15, non-ravel stitching is carried out according to the non-ravel stitch data and, thereafter, a first stitch of the stitch pattern is formed according to the stitch pattern data. The non-ravel stitch data is created so as to perform non-ravel stitching along the stitch of the stitch pattern to be formed. When the stitch pattern is a zigzag pattern 92 as shown in FIG. 8, for example, a direction of non-ravel stitching is decided according to first and second needle location data of the stitch pattern. Needle location data for forming three non-ravel stitch stitches 94 having a stitch pitch $P_s$ is then determined. The stitch pitch $P_s$ for non-ravel stitching may be necessarily smaller than the non-ravel stitch reference pitch $P_z$ (1 mm in this example), and it may be decided by computation or previously set to 0.5 mm, for example. When the pitch of the first stitch to be formed by the first and second needle location data is short as shown in FIG. 9, three non-ravel stitch stitches 96 cannot be formed along the first stitch of the stitch pattern. In this case, the needle location data for non-ravel stitching is created so that the third non-ravel stitch 96 may be formed along the second stitch. The creation of such needle location data for non-ravel stitching is similar to that described in detail in Japanese Laid-open Patent No. 1-262891, and the further detailed explanation will be therefore omitted.

After the execution of steps S13 to S15, the next needle location data for the formation of the second stitch of the stitch pattern is read out in step S16, and the needle location data read above is executed in step S17 to form the second stitch of the stitch pattern. In the next step S18, it is determined whether any one of interrupt commands is generated. The automatic sewing machine of the preferred embodiment is provided with a thread breakage detecting device for detecting thread breakage. When the thread breakage is detected by the thread breakage detecting device, a sewing machine stop command is generated to automatically stop the sewing machine. This sewing machine stop command is one of the interrupt commands. Further, the automatic sewing machine is also provided with an automatic thread trimming device for automatically trimming a thread after the formation of a series of stitches. In response to the operation of the automatic thread trimming device, another interrupt command is generated. An operation command for the automatic thread trimming device is classified into two kinds. One is a command for stopping the sewing machine after automatic thread trimming, and the other is a command for moving a position of the work fabric after automatic thread trimming and then continuing to sew without operating the start switch. These two kinds of operation commands comprise the other interrupt commands.

Since none of the interrupt commands as mentioned above is usually generated at this time, the answer in step S18 becomes NO. In the next step S19, it is determined whether the needle location data executed in step S17 is final needle location data. Since the answer in step S19 is usually NO, the program returns to step S16 to repeat the execution of steps S16 to S19 and form the stitch pattern. Finally, when final needle location data is executed in step S17, the answer in step S19 becomes YES. Thus, the formation of a series of stitches of the stitch pattern is ended.

When the answer in step S18 becomes YES prior to the completion of the formation of the stitch pattern, that is, if any one of the above three kinds of interrupt commands is generated, an interrupt processing is executed in step S20. During the execution of the interrupt processing, steps S21 and S22 are repeatedly executed. When the sewing machine is stopped upon detection of thread breakage or the operation of the automatic thread trimming device, the start switch is soon operated by the operator, and the answer in step S21 accordingly becomes YES. Further, when the formation of stitches is continued after automatic thread trimming, the answer in step S22 becomes YES. In any case, the program returns to step S12, and it is then determined in step S13 whether non-ravel stitching is required. If it is determined in step S13 that the non-ravel stitching is required, non-ravel stitch data is created in step S14, and it is then executed in step S15.

In the above description, the flow of the processing is primarily directed to the case where the non-ravel stitching is required. However, if all of the three stitch pitches are less than the non-ravel stitch reference pitch Pz, the non-ravel stitching is not required. That is, the answer in step S13 becomes NO, and the first stitch is formed in step S17 without execution of steps S14 and S15. Thereafter, steps S16 to S19 are repeatedly executed to form the stitch pattern.

There will now be described a second preferred embodiment of the present invention applied to non-ravel stitching to be carried out at the end of sewing of the stitch pattern, with reference to the flowchart shown in FIG. 10.

Figure 10:
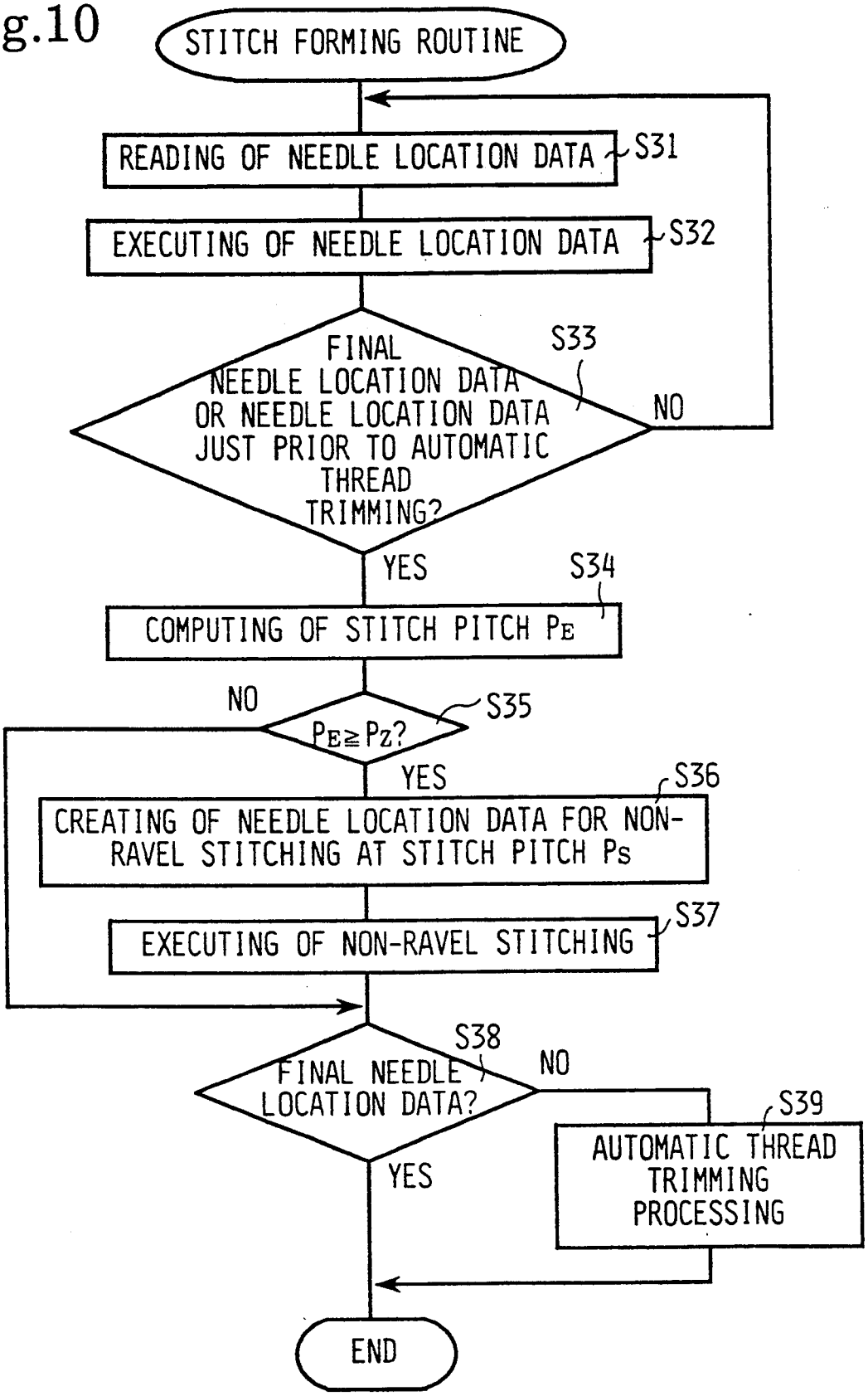
FIG. 10 is a flowchart of a stitch forming routine according to a second preferred embodiment of the present invention.

Referring to FIG. 10 showing a stitch forming routine according to the second preferred embodiment, steps S31 to S33 are repeatedly executed to form the stitch pattern. If the needle location data read out in step S31 is final needle location data, or if it is data just prior to the operation of the automatic thread trimming device, the answer in step S33 becomes YES. Non-ravel stitch data is then created in the subsequent steps S34 and so on.

In step S34, a final stitch pitch $P_E$ of the stitch pattern is computed. In step S35, it is determined whether the final stitch pitch $P_E$ is not less than the non-ravel stitch reference pitch $P_z$. If the final stitch pitch $P_E$ is less than the non-ravel stitch reference pitch $P_z$, the non-ravel stitching is not required. Accordingly, the program skips steps S36 and S37 to proceed to step S38. In step S38, it is determined whether the present needle location data is the final needle location data. If the answer in step S38 is YES, the formation of a series of stitches of the stitch pattern is ended. If the answer in step S38 is NO, an automatic thread trimming processing is carried out in step S39. Step S38 is executed only when the answer in step S33 is YES. Therefore, the answer of NO in step S38 means that the needle location data executed in step S32 was the data just prior to automatic thread trimming. Thus, the automatic thread trimming processing is carried out in step S39 to end the formation of a series of stitches of the stitch pattern.

On the other hand, if the answer in step S35 is YES, that is, if the final stitch pitch $P_E$ is greater than the non-ravel stitch reference pitch $P_z$, the non-ravel stitching is required, and the program therefore proceeds to step S36. In step S36, the non-ravel stitch data for performing the non-ravel stitching at the stitch pitch $P_s$ is created. In step S37, the non-ravel stitch data created is executed. As the creation and execution of the non-ravel stitch data are similar to those mentioned in the first preferred embodiment, the detailed explanation thereof will be omitted hereinafter.

In both the first and second preferred embodiments, the non-ravel stitch reference pitch $P_z$ as the criterion for determining whether the non-ravel stitching is required is different from the non-ravel stitch pitch $P_s$. However, both the pitches $P_z$ and $P_s$ may be made equal to each other. Further, although the non-ravel stitch reference pitch $P_z$ at the start of sewing is the same as that at the end of sewing, these pitches may be made different from each other.

In the second preferred embodiment, the requirement of the end non-ravel stitching is determined by determining whether the final single stitch pitch $P_E$ is equal to or greater than the non-ravel stitch reference pitch $P_z$. However, the requirement of the end non-ravel stitching may be determined by determining whether any one of plural stitch pitches at the end of sewing is equal to or greater than the non-ravel stitch reference pitch $P_z$. Further, the number of plural stitches of the stitch pattern at the start of sewing at the stitch pitch $P_n$ to be compared with the non-ravel stitch reference pitch $P_z$ may be arbitrarily set.

It is to be noted that the present invention is not limited to the aforementioned first and second preferred embodiments, but various modifications such as the following may be made without departing from the spirit of the present invention.

In both the preferred embodiments, the non-ravel stitch data is created at either the start or the end of sewing of the stitch pattern. However, the non-ravel stitch data may be created at both the start and the end of sewing of the stitch pattern.

The forming direction of the non-ravel stitch stitches is not limited to the direction along the stitches of the stitch pattern. For instance, the forming direction of the non-ravel stitch stitches may be made in accordance with the forming direction of the stitch pattern as a whole (i.e., vertical direction as viewed in FIG. 6).

In both the preferred embodiments, the non-ravel stitch data is stored into a memory area different from that in which the stitch pattern data is stored. This is due to the fact that the timing of the thread breakage or the interruption of the stitch formation depending upon an operator's will cannot be expected, and that it is preferable to handle the non-ravel stitch data separately from the stitch pattern data. However, the non-ravel stitch data for carrying out previously intended non-ravel stitching may be stored in the same memory area as that for storing the stitch pattern data. The non-ravel stitch data may be created by a data processing device independent of the sewing machine. For instance, the non-ravel stitch data created may be stored into a magnetic disk or a magnetic tape, and a reading device for reading the non-ravel stitch data stored in the magnetic disk or the magnetic tape may be provided in the sewing machine. With this construction, the stitch pattern data and the non-ravel stitch data previously created can be stored into the same memory area in the sewing machine.

Although the present invention is applied to the automatic sewing machine provided with the data processing device having stitch pattern expanding and contracting functions in the above preferred embodiments, the present invention may be applied to any automatic sewing machine provided with a data processing device not having the stitch pattern expanding and contracting functions.

In the above preferred embodiments, the contraction processing of needle location data constituting the stitch pattern data is carried out simultaneously with the disregard processing of the needle location data. However, the program may be modified so as to initially carry out the contraction processing of all the needle location data and then carry out the disregard processing. Conversely, the program may be modified such that the contraction reference pitch $P_{NG}$ is multiplied by a reciprocal number of the specified contraction rate to obtain a contraction reference value. The contraction reference value is compared with the stitch pitch obtained from the stitch pattern data prior to the contraction processing, and whether the needle location data should be disregarded or not is decided according to the result of comparison.

The above disregard processing and the non-creation of the non-ravel stitch data are particularly necessary when the stitch pitch is made remarkably small by the contraction processing of the stitch pattern data. Furthermore, the determination of the requirements of the disregard processing and the non-creation of the non-ravel stitch data is carried out by comparing the stitch pitch with each reference pitch. Because of such commonness between the disregard processing and the non-creation of the non-ravel stitch data, it is preferable to apply the present invention to a data processing device having a function of processing contraction of the stitch pattern data.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A non-ravel stitch data creating device for a sewing machine capable of forming a stitch pattern according to stitch pattern data, said non-ravel stitch data creating device comprising:

stitch pattern data storing means for storing the stitch pattern data;

stitch patch determining means for determining whether or not any stitch pitch of a predetermined number of stitches at at least one of the start and the end of the stitch pattern is equal to or greater than a predetermined reference pitch based on the stitch pattern data stored in said stitch pattern data storing means;

non-ravel stitch data creating means for creating non-ravel stitch data for performing non-ravel stitching at a stitch pitch less than any stitch pitch of the predetermined number of stitches at at least one of the start and the end of the stitch pattern when a result of determination by said stitch pitch determining means is affirmative, and for not creating non-ravel stitch data when the result of determination by said stitch pitch determining means is negative; and means for controlling the sewing machine on the basis of the created stitch pattern data.

2. The non-ravel stitch data creating device according to claim 1, further comprising:

contracting stitch pattern data creating means for creating contraction stitch pattern data for forming a contracted stitch pattern, wherein said stitch pitch determining means determines whether or not any one of stitch pitches of the predetermined number of stitches at at least one of the start and the end of the contracted stitch pattern is equal to or greater than the reference pitch based on the contraction stitch pattern data created by said contraction stitch pattern data creating means.

3. The non-ravel stitch data creating device according to claim 1, wherein the reference pitch is set to a minimum value of a stitch pitch which requires non-ravel stitching.

4. The non-ravel stitch data creating device according to claim 1, further comprising:

interruption detecting means for detecting interruption of forming of the stitch pattern by said sewing machine.

5. The non-ravel stitch data creating device according to claim 4, further comprising:

resumption detecting means for detecting resumption of forming of the stitch pattern by said sewing machine.

6. The non-ravel stitch data creating device according to claim 5, wherein said stitch pitch determining means determines whether or not any stitch pitch of the predetermined number of stitches at the resumption of the stitch pattern is equal to or greater than the reference pitch based on the remaining stitch pattern data of the stitch pattern when said resumption determining means detects resumption of forming of the stitch pattern after said interruption detecting means detects interruption of forming of the stitch pattern.

7. A method of creating non-ravel stitch data for use in a sewing machine capable of forming a stitch pattern according to stitch pattern data, comprising:

storing stitch pattern data;

determining whether or not any stitch pitch of a predetermined number of stitches at at least one of the start and the end of the stitch pattern is equal to or greater than a reference pith based on the stored stitch pattern data;

creating non-ravel stitch data for performing non-ravel stitching at a stitch pitch less than any stitch pitch of the predetermined number of stitches at at least one of the start and the end of the stitch pattern when a result of the determination is affirmative;

inhibiting creation of non-ravel stitch data when the result of the determination is negative; and controlling the sewing machine based on the created stitch pattern data.

8. A non-ravel stitch data creating device for a sewing machine capable of forming a stitch pattern according to stitch pattern data, said non-ravel stitch data creating device comprising:

stitch pattern data storing means for storing the stitch pattern data;

stitch pitch determining means for determining stitch pitch at at least one of the start and the end of the stitch pattern based on the stitch pattern data;

non-ravel stitch data creating means for creating non-ravel stitch data for performing non-ravel stitching at at least one of the start and the end of the stitch pattern only when no-ravel stitching is required, said non-ravel stitch data creating means operating in response to the determination by said stitch pitch determining means; and means for controlling the sewing machine on the basis of the created stitch pattern data;

wherein said stitch pitch determining means determined whether or not a stitch pitch of a predetermined number of stitches at at least one of the start and the end of the stitch pattern is equal to or greater than a predetermined reference pitch.

9. The non-ravel stitch data creating device according to claim 8, wherein the non-ravel stitch data creating means creates non-ravel stitch data for performing non-ravel stitching at a stitch pitch less than any stitch pitch of the predetermined number of stitches at at least one of the start and the end of the stitch pattern when a result of the determination by said stitch pitch determining means is affirmative and does not create non-ravel stitch data when the result of the determination is negative.

10. The non-ravel stitch data creating device according to claim 8, further comprising:

interruption detecting means for detecting interruption of forming of the stitch pattern by said sewing machine.

11. The non-ravel stitch data creating device according to claim 10, further comprising:

resumption detecting means for detecting resumption of forming of the stitch pattern by said sewing machine.

12. The non-ravel stitch data creating device according to claim 11, wherein said stitch pitch determining means determines whether or not any stitch pitch of the predetermined number of stitches at resumption of the stitch pattern is equal to or greater than the reference pitch based on the remaining stitch pattern data of the stitch pattern when said resumption determining means detects resumption of forming of the stitch pattern after said interruption detecting means detects interruption of forming of the stitch pattern.

13. The non-ravel stitch data creating device according to claim 8, further comprising:

contraction stitch pattern data creating means for creating contraction stitch pattern data for forming a contracted stitch pattern, wherein said stitch pitch determining means determines stitch pitch at at lest one of the start and the end of the contracted stitch pattern based on the contraction stitch pattern data.

* * * * *